US009146087B2

(12) United States Patent
Cottrell et al.

(10) Patent No.: US 9,146,087 B2
(45) Date of Patent: Sep. 29, 2015

(54) UNIVERSAL AMMUNITION CASE TRIMMING AND PREPARATION APPARATUS

(71) Applicant: Battenfeld Technologies, Inc., Columbia, MO (US)

(72) Inventors: Michael Cottrell, Columbia, MO (US); James Gianladis, Harrisburg, MO (US); Adam J. Birk, Hallsville, MO (US); Tim Kinney, Columbia, MO (US)

(73) Assignee: Battenfeld Technologies, Inc., Columbia, MI (US)

( * ) Notice: Subject to any disclaimer, the term of this patent is extended or adjusted under 35 U.S.C. 154(b) by 0 days.

(21) Appl. No.: 14/212,931

(22) Filed: Mar. 14, 2014

(65) Prior Publication Data

US 2014/0318352 A1 Oct. 30, 2014

Related U.S. Application Data

(60) Provisional application No. 61/792,180, filed on Mar. 15, 2013.

(51) Int. Cl.
*F42B 33/10* (2006.01)

(52) U.S. Cl.
CPC ..... *F42B 33/10* (2013.01)

(58) Field of Classification Search
CPC ..... F42B 33/10
USPC ..... 86/19.5, 19.7
See application file for complete search history.

(56) References Cited

U.S. PATENT DOCUMENTS

| | | | | | |
|---|---|---|---|---|---|
| 2,359,931 | A | * | 10/1944 | Moffitt | 408/67 |
| 2,744,307 | A | * | 5/1956 | Smiley | 86/19.7 |
| 3,157,407 | A | * | 11/1964 | Aulabaugh | 279/36 |
| 3,174,390 | A | * | 3/1965 | Jacobsen | 86/24 |
| 3,274,661 | A | * | 9/1966 | Westbrook | 86/19.7 |
| 4,325,282 | A | * | 4/1982 | Schaenzer | 86/24 |
| 4,653,157 | A | * | 3/1987 | Alexander | 86/19.7 |
| 4,686,751 | A | | 8/1987 | Gracey | |
| 5,309,813 | A | * | 5/1994 | Henley | 86/23 |
| 5,497,539 | A | * | 3/1996 | Blodgett et al. | 86/19.7 |

(Continued)

OTHER PUBLICATIONS

Squibloads Gun Thoughts, What is the Best Case Trimmer?, http://squibloads.wordpress.com/reloading/what-is-the-best-case-trimmer/, 7 pages, admitted prior art [internet accessed Jul. 15, 2014].

Dillon's Rapid Trim 1200B Case Trimmer: Case Preparation Equipment, http://www.dillonprecision.com/content/p/9/pid/23636/catid/8/Dillon_039_s_Rapid_Trim_1200B_Case_Trimmer, 1 page, admitted prior art [internet accessed Jul. 15, 2014].

Giraud Tool Company, Inc., Giraud Powered Case Trimmer, http://www.giraudtool.com/Giraud%20Trimmer.pdf, 9 pages, admitted prior art.

(Continued)

*Primary Examiner* — Bret Hayes
(74) *Attorney, Agent, or Firm* — Senniger Powers LLP

(57) ABSTRACT

A case preparation and/or trimming assembly. The assembly may include a case shoulder engagement surface and a cutter. The spacing between the case shoulder engagement surface and the cutter is adjustable for changing the amount the cutter trims from a case. A case body engaging member may have an adjustable inner diameter for engaging bodies of cases having different diameters. A kit includes a case trimming assembly and a plurality of interchangeable case bearings (e.g., collets and/or bushings) adapted for engaging cases of different sizes for guiding the cases into proper position with respect to a cutter. The case preparation apparatus includes a support member for supporting a trimming assembly of the apparatus in an upwardly inclined orientation. The case preparation apparatus includes a storage container. Associated methods are also disclosed.

21 Claims, 11 Drawing Sheets

(56) References Cited

U.S. PATENT DOCUMENTS

| | | | | |
|---|---|---|---|---|
| 5,727,295 | A | 3/1998 | Gracey | |
| 5,788,429 | A | 8/1998 | Gracey | |
| 6,484,616 | B1 | 11/2002 | Giraud | |
| 7,155,789 | B1 * | 1/2007 | Gracey | 29/33 T |
| 7,650,825 | B1 * | 1/2010 | Lee et al. | 86/19.7 |
| 2011/0232467 | A1 * | 9/2011 | Keska | 86/24 |

OTHER PUBLICATIONS

Match Prep, Home of the Gracey Power Cartridge Case Trimmer, http://www.matchprep.com/trimmer.htm, 1 page, admitted prior art [internet accessed Mar. 19, 2014].

* cited by examiner

UNIVERSAL AMMUNITION CASE TRIMMING AND PREPARATION APPARATUS

CROSS-REFERENCE TO RELATED APPLICATION

This application claims priority to U.S. Provisional Patent Application No. 61/792,180, filed Mar. 15, 2013, which is hereby incorporated by reference in its entirety.

FIELD OF THE INVENTION

The present disclosure generally relates to an apparatus for preparing ammunition casing for re-loading, and more particularly to an apparatus for trimming and performing other operations on ammunition casings having a variety of sizes.

BACKGROUND OF THE INVENTION

After a round of ammunition has been fired, a casing or case of the round may be re-used by reloading it with a primer, a propellant, and a bullet. As an initial step in the re-loading process, the mouth of a case may need to be trimmed to reduce the length of the case and/or square the opening of the mouth with the longitudinal axis of the case. It is desirable to achieve precise and consistent trimming of cases and to provide them with a square mouth for proper firing of re-loaded rounds of ammunition and potentially increased firing accuracy. Besides trimming the case, other operations may be performed such as chamfering, de-burring, and uniforming.

SUMMARY

In one aspect of the present invention a case trimming apparatus is for trimming an ammunition case including a neck having a mouth to be trimmed, a shoulder behind the mouth, and a body behind the shoulder. The case trimming apparatus includes a housing and a cutter head supported by the housing for trimming the mouth of the case. The case trimming apparatus also includes a case guide supported by the housing for guiding the case into position with respect to the cutter head for trimming the mouth of the case. The case guide includes a case bearing bounding a case receiving opening sized and shaped for reception of the case in the case guide. The case bearing includes a case shoulder engagement member constructed to engage the case shoulder for determining a trim length of the case. The case bearing includes a case body engagement member constructed to engage the case body for orienting the case with respect to the cutter head. The case bearing is adjustable to adjust a width of the case receiving opening to correspond to a width of the case.

In another aspect of the present invention a case trimming apparatus is for trimming an ammunition case including a neck having a mouth to be trimmed, a shoulder behind the mouth, and a body behind the shoulder. The case trimming apparatus includes a housing and a cutter head supported by the housing for trimming the mouth of the case. The case trimming apparatus includes a case guide supported by the housing for guiding the case into position with respect to the cutter head for trimming the mouth of the case. The case guide includes a receiver sized for receiving a case bearing configured for positioning the case with respect to the cutter head. The case trimming apparatus also includes a kit of multiple case bearings each being selectively receivable in the receiver for bounding a case receiving opening sized and shaped for reception of the case in the case guide. The kit of multiple case bearings includes at least one case shoulder engagement member constructed to engage the case shoulder for determining a length of the case to be trimmed. The kit of multiple case bearings includes at least one case body engagement member separate from the at least one case shoulder engagement member constructed to engage the case body for orienting the case with respect to the cutter head.

In still another aspect of the present invention a case trimming apparatus is for trimming an ammunition case including a neck having a mouth to be trimmed, a shoulder behind the mouth, and a body behind the shoulder. The case trimming apparatus includes a housing and a cutter head supported by the housing for trimming the mouth of the case. The case trimming apparatus also includes a case guide supported by the housing for guiding the case into position with respect to the cutter head for trimming the mouth of the case. The case guide includes a tubular shroud and a case bearing in the tubular shroud configured for engaging the case and positioning the case with respect to the cutter head. The tubular shroud of the case guide at least partially houses the cutter head.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Referring to FIGS. 1-4, a universal case trimming and preparation apparatus is designated generally by the reference number 10. As will become apparent, the apparatus 10 is useful for performing several tasks associated with re-loading ammunition cases. The apparatus 10 is "universal" not only because it is adaptable for performing a wide variety of tasks but also because it is adjustable to trim and prepare a wide variety of sizes and types of cases. For example, as explained in further detail below, the apparatus 10 is adjustable for trimming cases of a wide variety of cartridges of varying body, neck, shoulder, and mouth dimensions and for ensuring the case mouths of the cases are trimmed square to the longitudinal axes of the cases.

Figure 1:
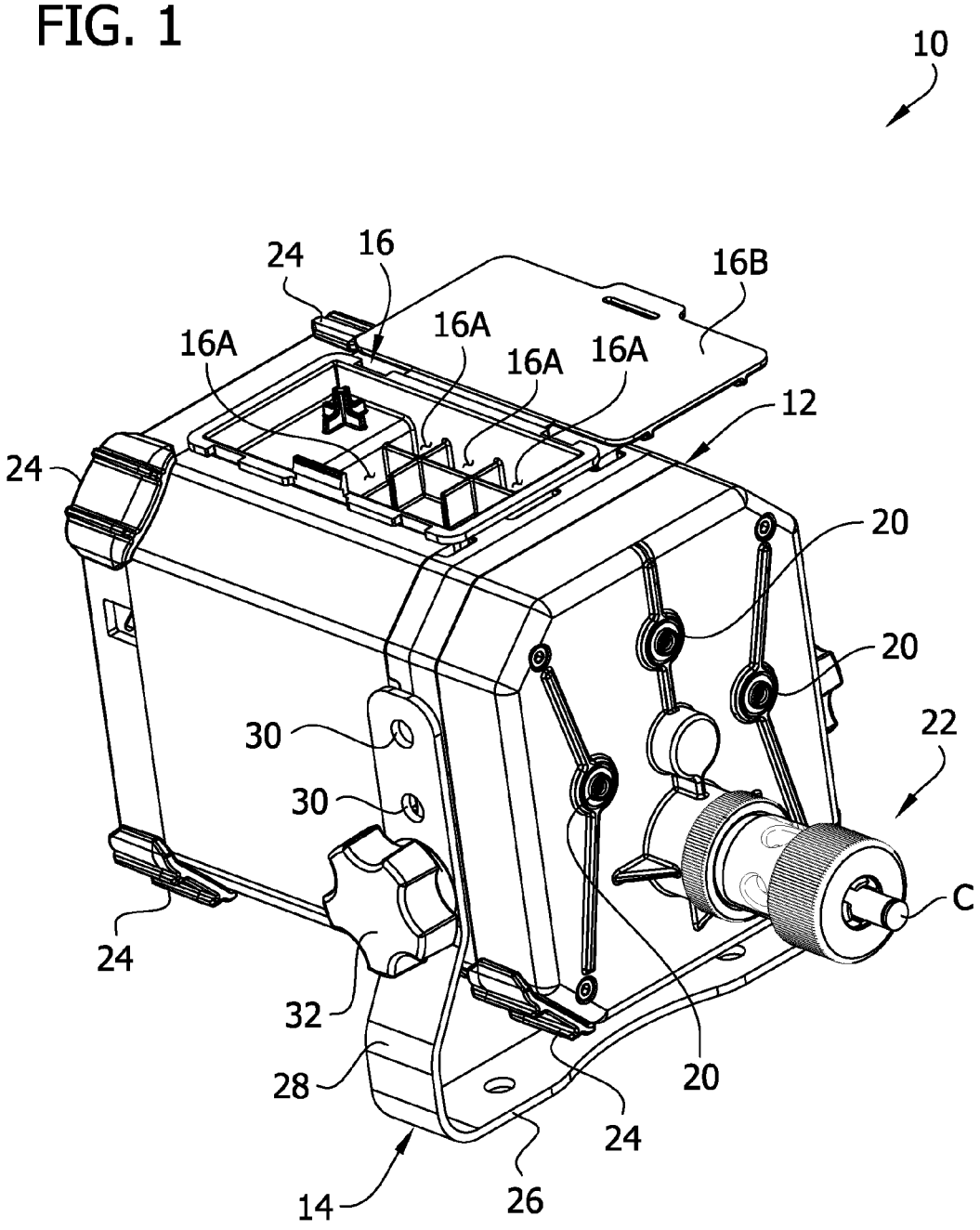
FIG. 1 is a front and left side perspective of a case trimming and preparation apparatus of the present invention.
Figure 2:
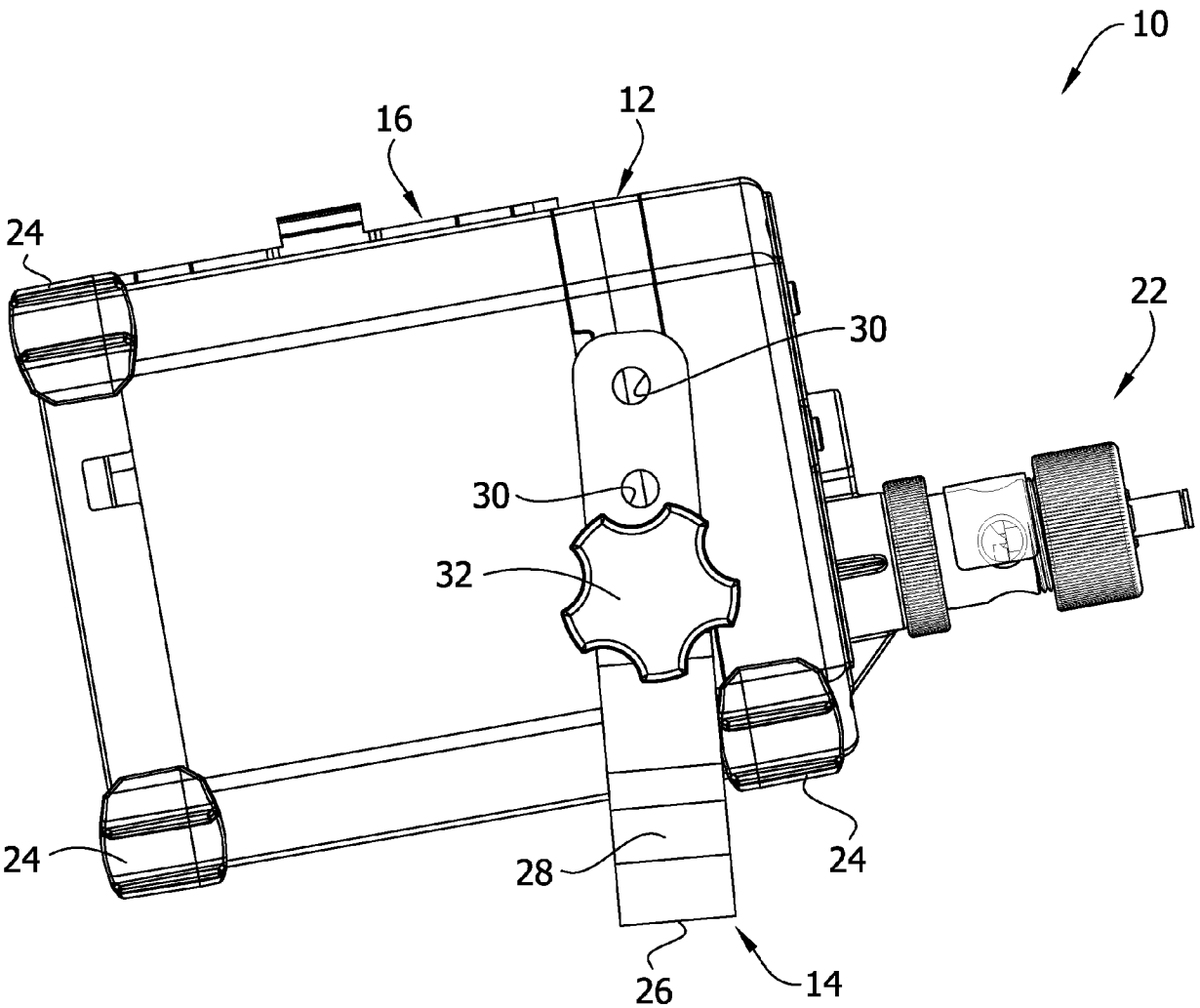
FIG. 2 is a front elevation of the apparatus of FIG. 1.

As shown in FIG. 1, the apparatus 10 includes a box-like housing 12, a support member 14, and a storage container 16. The housing 12 has a front end including several selectively rotatable output shafts 20 and a case trimming assembly 22.

The housing 12 has a rear end opposite the front end and top, bottom, and left and right side walls extending between the front and rear ends. As explained in further detail below, the housing 12 houses internal drive components of the output shafts 20 and the trimming assembly 22.

Figure 3:
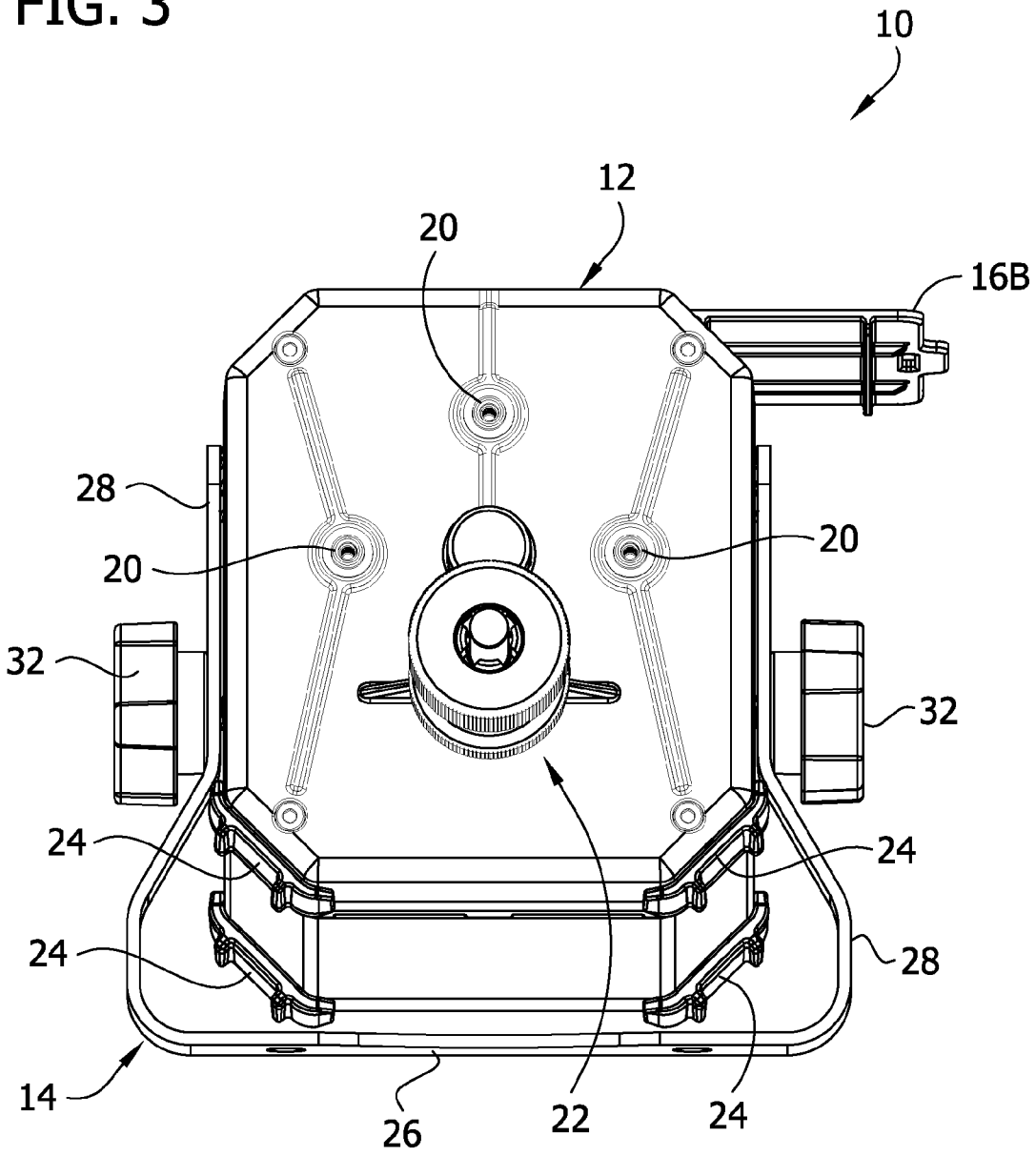
FIG. 3 is a left side elevation of the apparatus.
Figure 4:
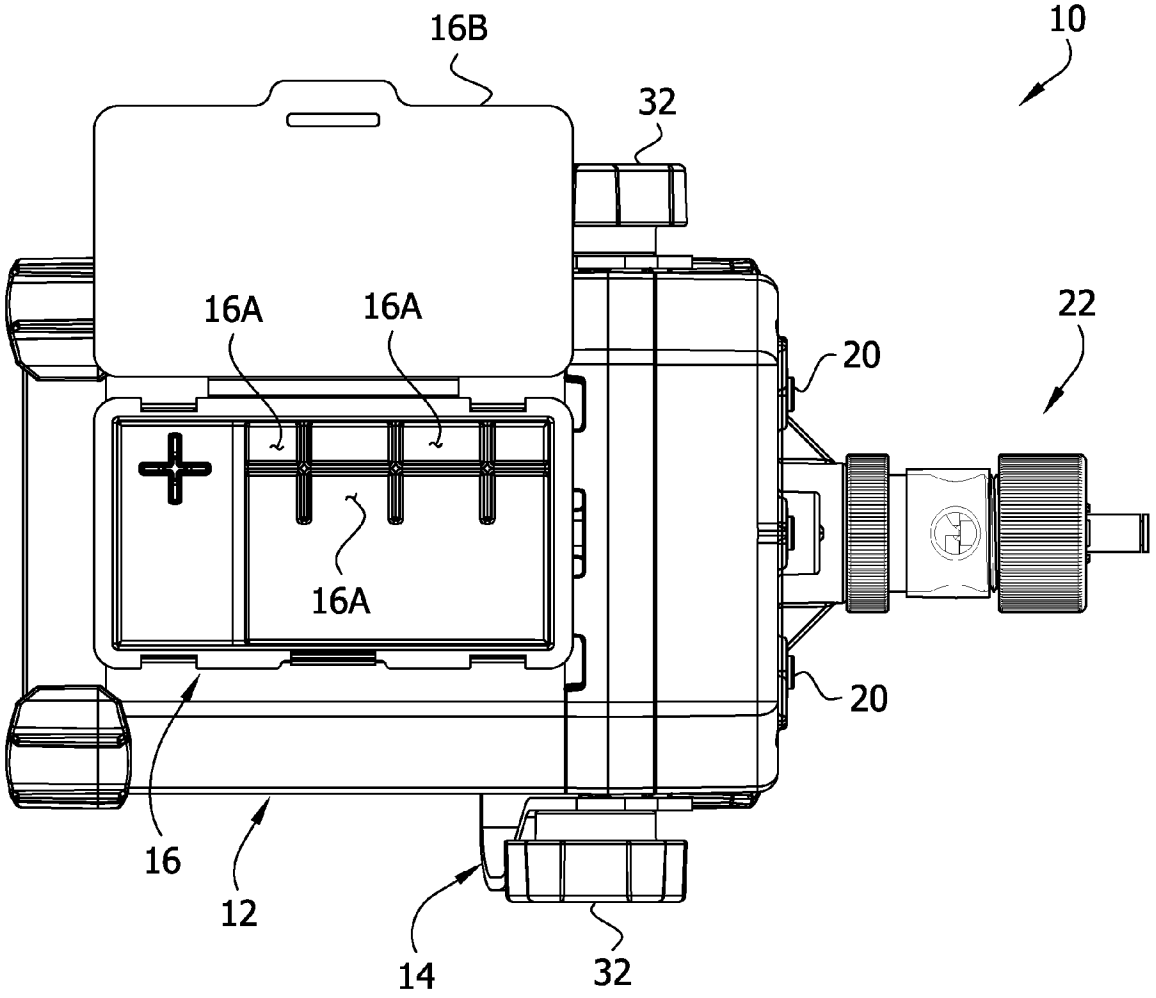
FIG. 4 is a top view of the apparatus.

The apparatus 10 includes a plurality of feet 24, which in combination with the support member 14, provide a variety of options for supporting the housing 12 on a support surface. The apparatus 10 includes feet 24 positioned on six of the eight corners of the housing 12. In the illustrated embodiment, the two feet 24 positioned at the rear corners of the bottom side are used in combination with the support member 14 for supporting the front end of the housing 12 in a raised position relative to the rear end. This orients the front end upward slightly to facilitate visibility and access to the trimming assembly 22 and output shafts 20. As shown in FIG. 3, the support member 14 has a generally U-shape including an elongate base 26 and two arms 28 extending laterally with respect to the base at opposite ends of the base. The arms 28 are connected to opposite sides of the housing 12 toward the front of the housing. The arms 28 each include three holes 30 spaced from each other along the lengths of the arms. The arms 28 are connected to the sides of the housing 12 by fasteners 32 each including a knob-like head and a threaded shaft passing through a respective hole in one of the arms and threaded into an opening in the housing. In the illustrated configuration, the fasteners 32 are passed through the holes 30 in the arms closest to the base 26 of the support member 14. The front end could be supported in a higher position by removing the fasteners 32, aligning the holes in the sides of the housing 12 with a set of holes 30 in the arms 28 spaced farther from the base 26, and re-fastening the arms to the housing 12 by passing the threaded shafts of the fasteners through the newly aligned set of holes into the sides of the housing. The fasteners 32 define a pivot axis about which the support member 14 is pivotable with respect to the housing 12 for moving it to various positions. For example, the support member 14 may be pivoted to position a bottom surface of the base 26 in flatwise engagement with a support surface no matter which set of holes 30 in the arms 28 is used to connect the support member to the housing 12. Moreover, the support member 14 may be pivoted to any desired position for holding it as a handle to carry the apparatus 10. In addition, the support member 14 may be disconnected from the housing 12 or pivoted out of the way such that the housing may rest substantially horizontally on the support surface. The rear end may be supported generally horizontally above a support surface using the four feet 24 protruding from the rear end, or the bottom side may be supported generally horizontally above the support surface using the four feet 24 protruding from the bottom side.

The storage container 16 includes various compartments 16A that may be used for storing tools, bits, collets, bushings, and other items associated with preparing cases for re-loading. For example, bits and tools mountable on the output shafts 20 may be stored in the container 16. The container 16 is recessed in the top wall of the housing 12. A door 16B of the storage container 16 is shown in an open position. The door may be latched in a closed position for retaining items inside the container 16.

Figure 5:
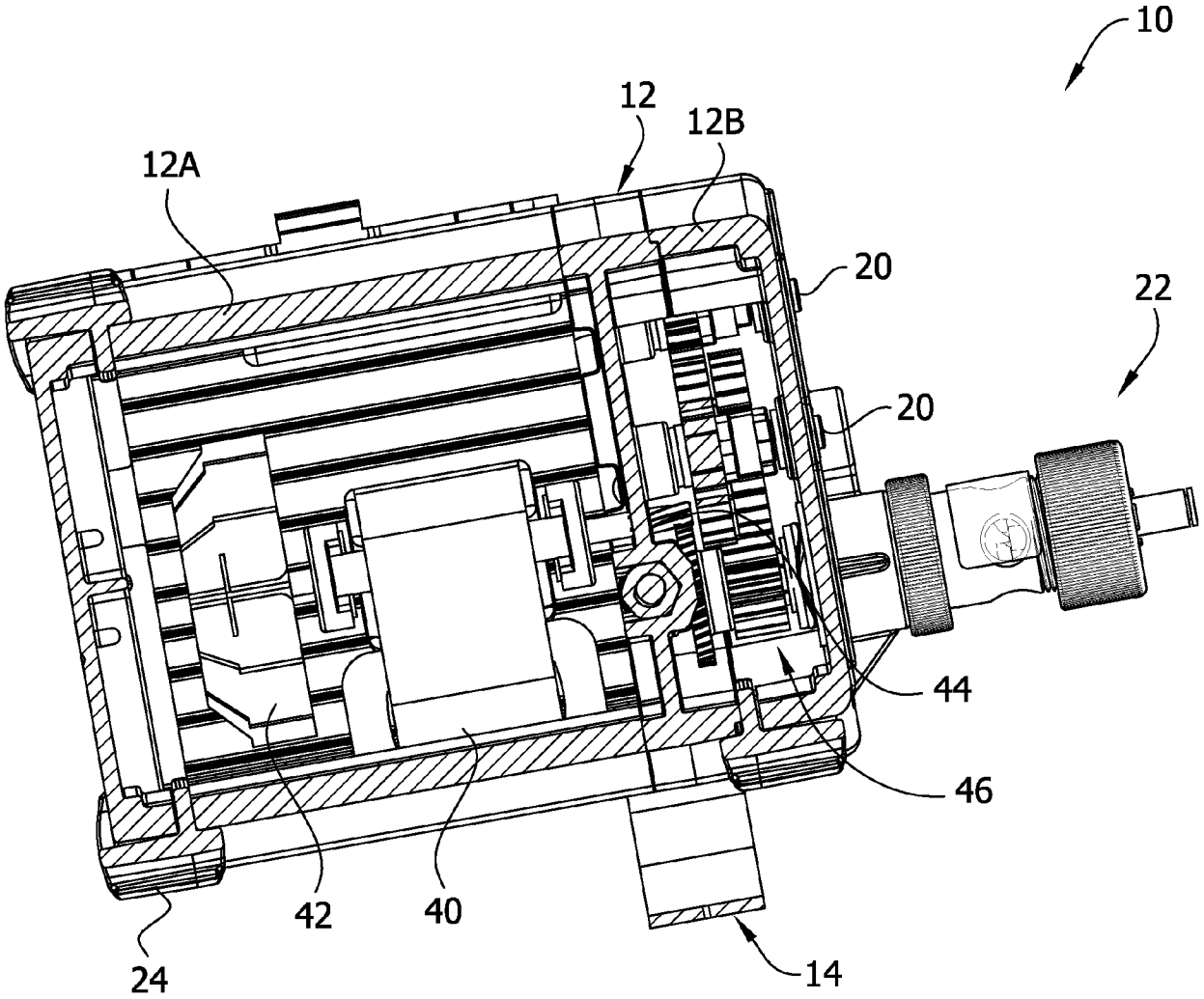
FIG. 5 is a left side elevation of FIG. 3 with parts of a housing broken away to show internal construction.
Figure 6:
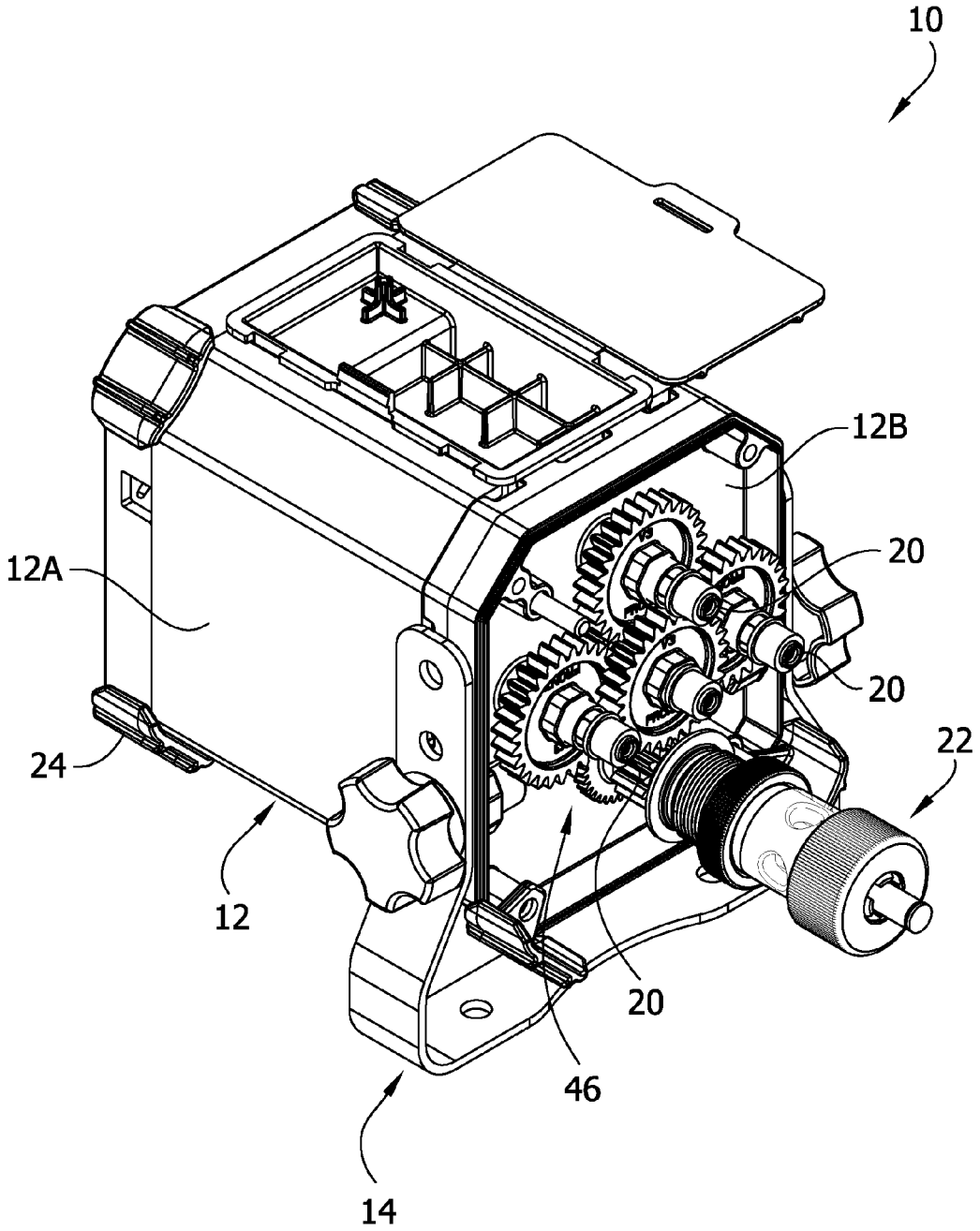
FIG. 6 is a front and left side perspective of the apparatus with a front part of the housing removed to expose drive gears.

Referring to FIGS. 5 and 6, the housing 12 includes a motor housing section 12A and a gear housing section 12B. A motor 40 inside the motor housing section 12A drives a cooling fan 42 adjacent the motor and rotates a primary drive shaft 44 in operative engagement with a plurality of gears 46 in the gear housing section 12B. The gears 46 are selectively intermeshed so that the motor 40 can drive rotation of the output shafts 20 and operate a cutter of the trimming assembly 22.

Figure 7:
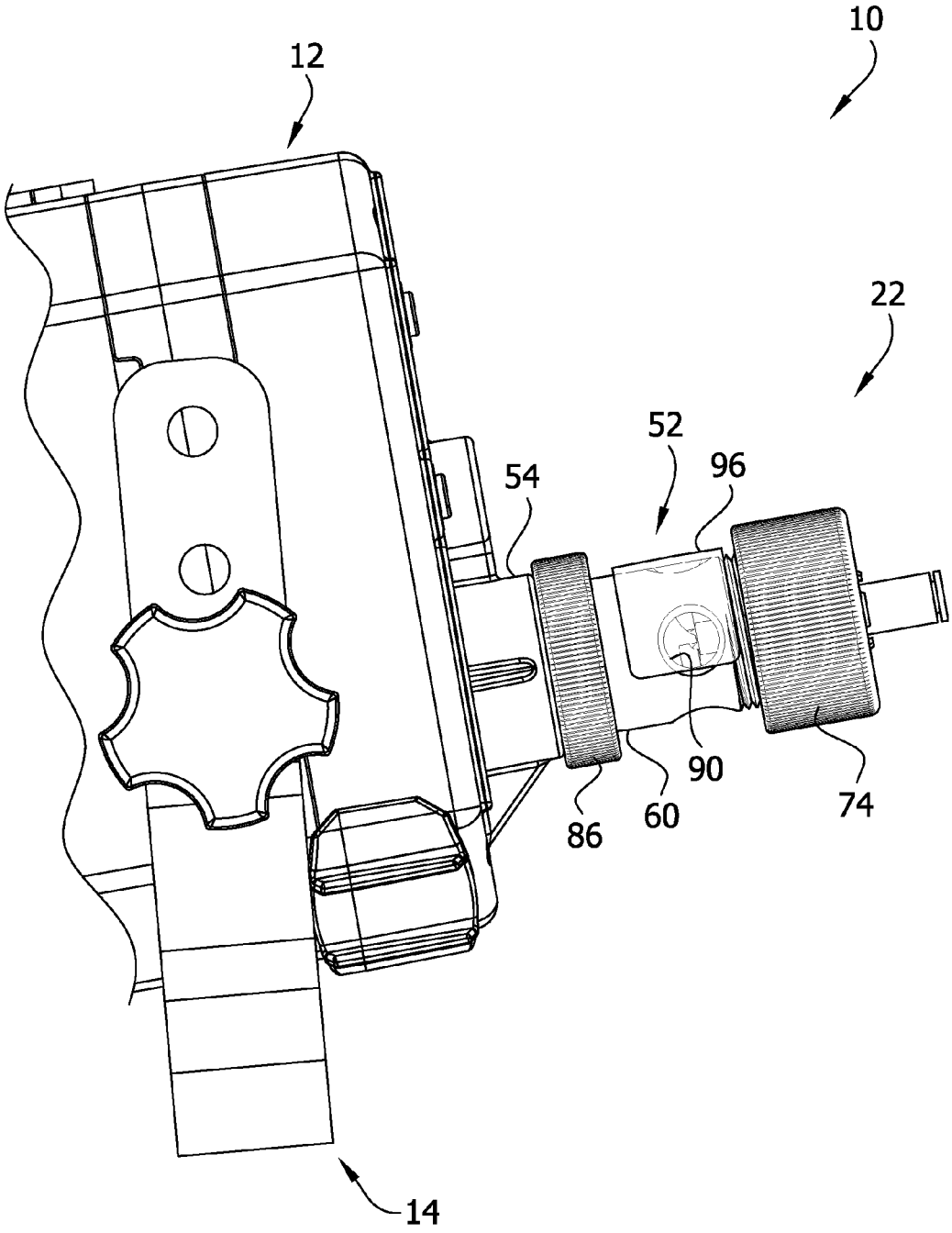
FIG. 7 is an enlarged fragmentary side elevation of the apparatus showing a trimming assembly.
Figure 8:
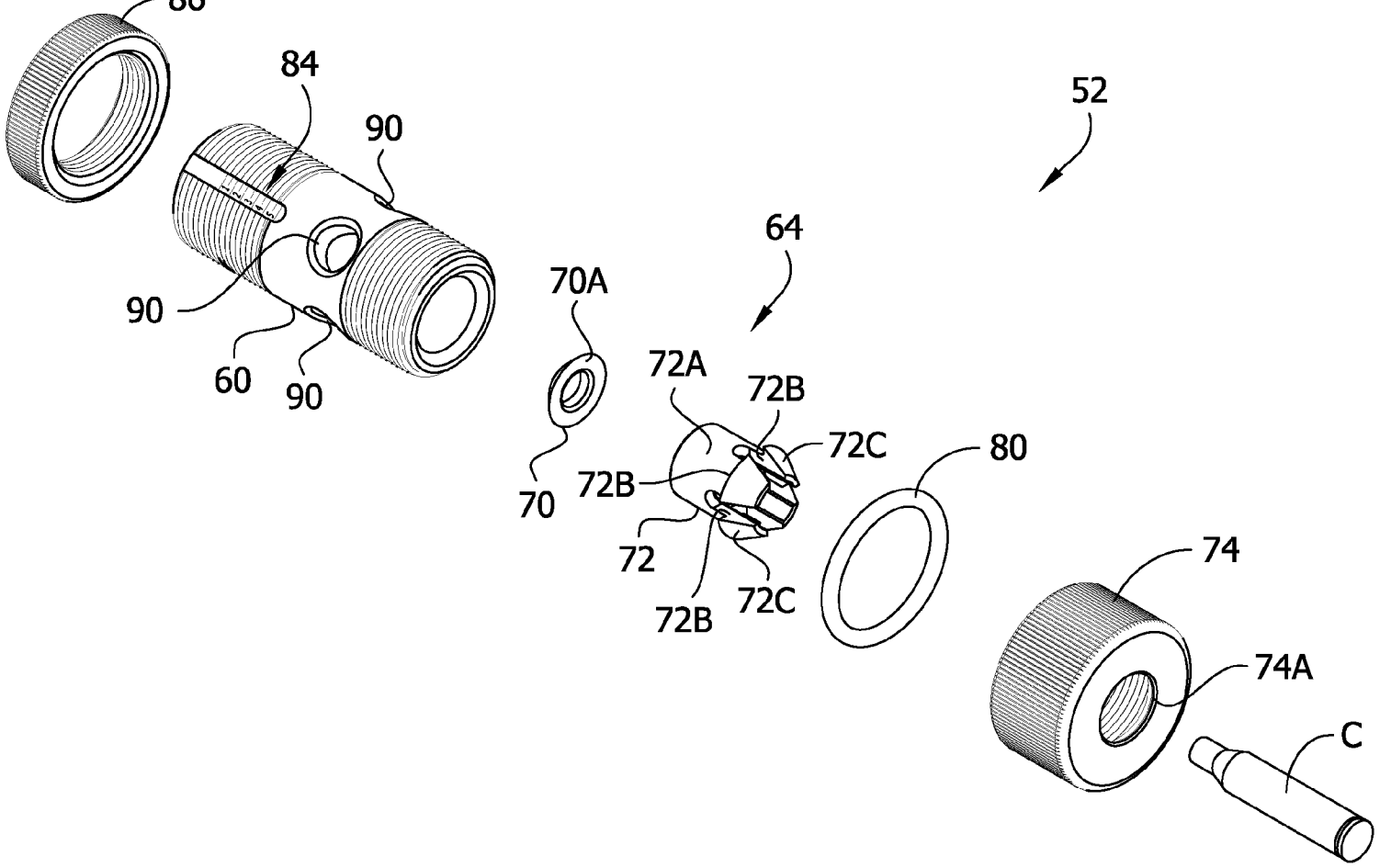
FIG. 8 is an increased scale exploded view of a case guide of the trimming assembly.
Figure 9:
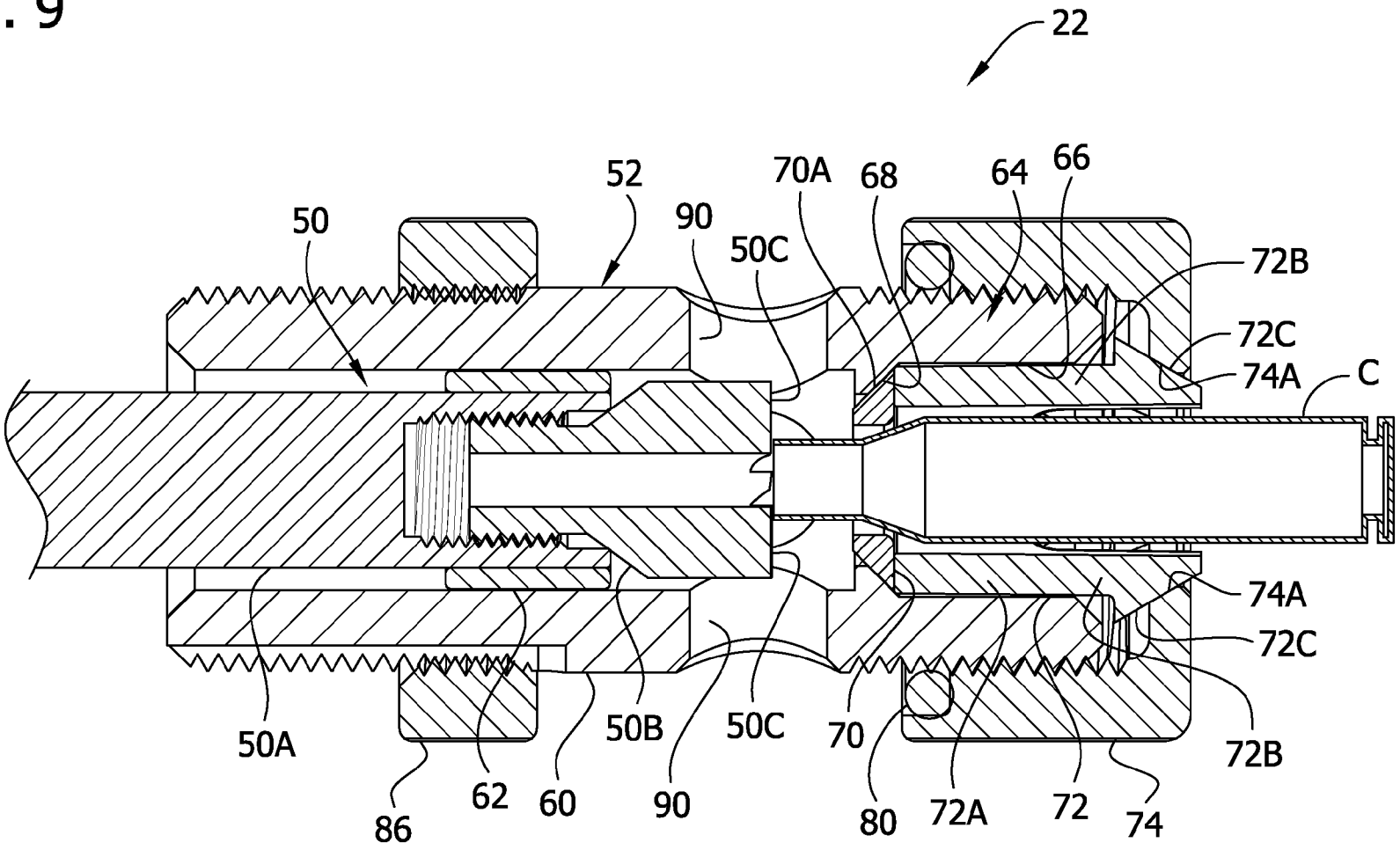
FIG. 9 is a longitudinal section of the trimming assembly.

Referring to FIGS. 7-9, the trimming assembly 22 protrudes from the front end of the housing 12 and includes a variety of components. The trimming assembly 22 includes a cutter 50 and a case guide 52 adapted for guiding a case C into position with respect to the cutter. As will become apparent, the case C may be inserted into an open end of the case guide 52 for engaging the mouth of the case with the cutter 50. The case guide 52 guides the case into proper orientation with respect to the cutter 50 and into proper axial position with respect to the cutter for achieving a desired trimmed length of the case and a squarely trimmed case mouth.

The cutter 50 extends out of the housing 12 through a tubular neck 54 (FIG. 7) protruding from the front end of the housing. The cutter 50 includes a shaft 50A which extends through the tubular neck 54 and a head 50B positioned at a distal end of the shaft. In the illustrated embodiment, the cutter head 50B is formed separately from the shaft 50A and is threaded into a socket in the end of the shaft. The cutter 50 has a longitudinal axis about which it rotates by driving force of the motor 40. The cutter head 50B includes blades 50C at the tip of the head extending transversely with respect to the longitudinal axis of the cutter 50.

The case guide 52 includes a tubular shroud 60 having opposite threaded ends. A rear end of the tubular shroud 60 is adapted for threaded connection with the tubular neck 54. The rear end of the tubular shroud 60 houses the cutter shaft 50A, and an intermediate portion of the tubular shroud houses the cutter head 50B. An annular bearing 62 is positioned around the cutter shaft 50A in the tubular shroud 60 for centering the cutter 50 in the tubular shroud. The front end of the tubular shroud 60 includes a receiver adapted for receiving a case bearing 64 configured for guiding axial movement of a case toward the cutter 50 and positioning the case with respect to the cutter. The receiver includes a generally cylindrical cavity 66 opening out of the front end of the tubular shroud 60 and an annular bearing surface 68 protruding radially inwardly at a forward end of the cylindrical cavity. The annular bearing surface 68 tapers radially inwardly from a rear end of the bearing surface to a front end of the bearing surface adjacent the cutter 50. In the illustrated embodiment, the case bearing 64 in the receiver includes a bushing 70 (broadly "case shoulder engagement member") and a collet 72 (broadly "case body engagement member"). The bushing 70 and collet 72 are shown as two separate parts, but it will be appreciated that they may be formed as a single piece or connected to each other without departing from the scope of the present invention. The bushing 70 is received through the open front end of the tubular shroud 60 and is followed by the collet 72. A cap 74 (broadly "collet adjustment member") is threaded over the front end of the tubular shroud 60 and retains the bushing 70 and collet 72 in position in the receiver.

The bushing 70 has an annular case shoulder engaging surface adapted for engaging the shoulder of the case C to center the front end of the case in the receiver and position the case axially with respect to the cutter 50 for achieving a desired trimmed length of the case. The bushing 70 includes an annular rear bearing surface 70A which is tapered to correspond to the taper of the bearing surface 68 of the receiver. Engagement of the bearing surface 70A of the bushing 70 with the bearing surface 68 of the receiver centers the bushing in the tubular shroud 60 and aligns the center of the bushing with the longitudinal axis of the cutter 50. A rear end of the collet 72 engages the front side of the bushing 70, and rotation of the cap 74 onto the tubular shroud 60 presses the collet against the front side of the bushing, tending to maintain the bushing in its centered position due to the engagement of the bushing and receiver bearing surfaces 70A, 68. The bushing 70 has an inside diameter sized for engaging the shoulder of the case. Engagement of the shoulder with the bushing 70 centers the front end of the case in the receiver and positions the case axially with respect to the cutter 50 preventing more than a desired length of the case mouth from being trimmed.

The collet 72 is adapted for engaging the body of the case C to center a rear portion of the case in the receiver and, in combination with the bushing 70, align the longitudinal axis of the case with the longitudinal axis of the cutter 50 for achieving a squarely trimmed case mouth. The collet 72 includes a rear annular portion 72A and four fingers 72B extending rearward from the annular portion. Other numbers of fingers may be used without departing from the scope of the present invention. The fingers 72B are spaced from one another about the circumference of the collet 72 to permit the fingers to deflect radially inward. Each finger 72B includes an outer bearing surface 72C which tapers radially inward from a rear end of the bearing surface to a front end of the bearing surface. The cap 74 includes a corresponding tapered interior annular bearing surface 74A extending around an opening which permits entry of the case into the receiver. The fingers 72B of the collet 72 as shown in FIG. 9 are in a relaxed or non-deflected state. Rotation of the cap 74 tending to draw the cap toward the cutter 50 moves the annular bearing 74A surface of the cap rearward along the finger bearing surfaces 72C. An O-ring 80 received in an annular recess in the front end of the cap 74 secures the cap in a particular rotational position by frictional engagement with the tubular shroud 60 and the cap. The cap 74 may be rotated a sufficient amount to cause the fingers 72B to deflect sufficiently inward so that inner surfaces of each finger (broadly "case body engagement surfaces") adjacent the ends of the fingers engage the case body. Engagement of the case body by the fingers 72B at various circumferential positions on the case body centers the rear portion of the case in the receiver. It will be appreciated that this step may be performed as an initial step to position the collet fingers 72B appropriately for the particular diameter of the case body before energizing the cutter 50. The engagement of the case shoulder with the bushing 70 and the engagement of the case body with the collet fingers 72B aligns the longitudinal axis of the case with the longitudinal axis of the cutter 50 for achieving a squarely trimmed case mouth when it is engaged with the rotating cutter.

Figure 10:
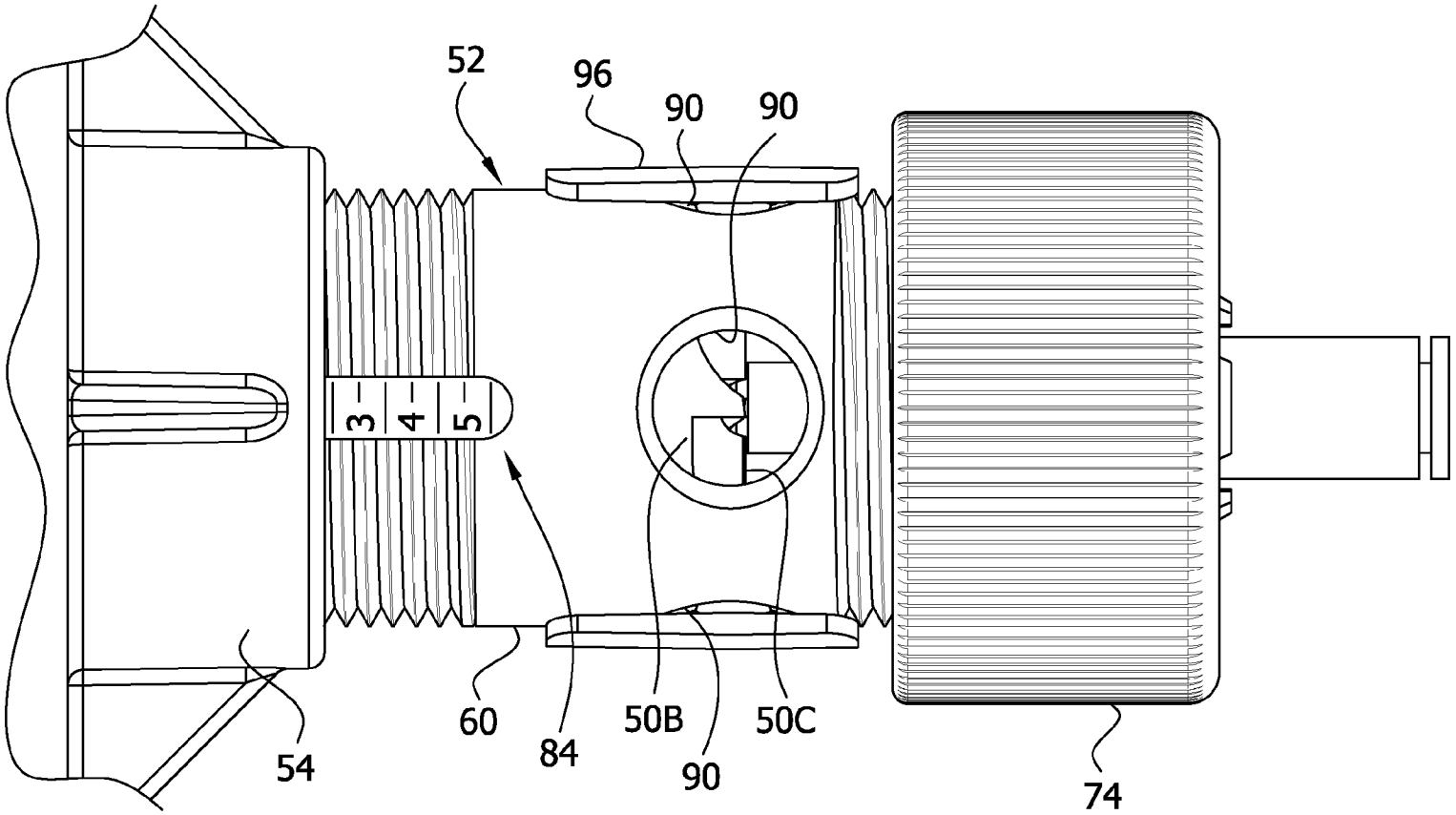
FIG. 10 is a fragmentary side elevation of the trimming assembly having a locking ring removed to expose measurement marks for determining a trimming length.

The length to which the case is trimmed may be adjusted by moving the position of the case shoulder bearing surface of the bushing 70 with respect to the cutter 50. This can be accomplished by rotating the tubular shroud 60 to advance it into or out of the neck 54, depending on whether the case trim length is to be shortened or lengthened. As shown in FIG. 10, the tubular shroud 60 may include measurement marks 84 for assisting in advancing the tubular shroud into or out of the neck 54 to a desired position. The measurement marks 84 are spaced from one another along the length of the tubular shroud 60 in a channel which disrupts the thread on the front end of the tubular shroud. A position of one of the measurement marks 84 with respect to the rim of the neck 54 can be noted by a user and used in the future for adjusting the tubular shroud 60 to the same position for achieving the same trimmed case length. Referring to FIGS. 7 and 9, the case guide 52 includes a threaded ring 86 (broadly "locking member") for locking the tubular shroud 60 in position with respect to the neck 54 and thus the cutter 50. The threaded ring 86 is not shown in FIG. 10 to expose the measurement marks. After the tubular shroud 60 is rotated in the neck 54 to a desired position (e.g., by reference to the measurement marks 84), the ring 86 may be rotated into engagement with the rim of the neck. Frictional engagement of the ring 86 with the neck 54 locks the tubular shroud 60 in position with respect to the neck and thus locks the case shoulder engaging surface of the bushing 70 in position with respect to the cutter head 50B.

As is now apparent, the trimming assembly 22 can be adjusted in various ways for facilitating trimming a case to have a desired length and a square mouth. The case shoulder bearing surface of the bushing 70 can be moved axially with respect to the cutter 50 by rotating the tubular shroud 60. The collet fingers 72B can be deflected radially inward for engaging the rear portion of the case body. This provides adjustability for accommodating cases of a wide variety of cartridges of varying body, neck, shoulder, and mouth dimensions and different required trimmed lengths. The range of adjustability can be increased by providing a plurality of interchangeable bushings and/or collets. For example, bushings having different internal diameters may be provided to enable a user to select a bushing sized appropriately for engaging a shoulder of a particular case. Likewise, a plurality of collets having different internal diameters may be provided to enable a user to select a collet sized appropriately for engaging the body of a particular case. In general, a smaller diameter case body may require a bushing or collet having a smaller inner diameter, and a larger diameter case body may require a bushing or collet having a larger inner diameter. Furthermore, a smaller diameter case neck may require a bushing having a smaller inner diameter, and a larger diameter case neck may require a bushing having a larger inner diameter. The bushing 70 and collet 72 being separate from each other enables the user to choose any bushing/collet combination. The bushing 70 and collet 72 in the receiver can be swapped with other bushings and collets by removing the cap 74 from the end of the tubular shroud 60. The plurality of bushings and/or collets may be provided as a kit together with the apparatus (e.g., for storage in the container 16). This is a very cost effective way to cover a wide variety of cartridge cases with a high degree of precision.

After the trimming assembly 22 has been adjusted according to the case to be trimmed (e.g., by selecting and installing an appropriately sized bushing 70 and collet 72, adjusting the position of the bushing axially with respect to the cutter 50, and adjusting the inner diameter of the collet), trimming may be accomplished by holding the rear end of the case body by hand and pushing the mouth of the case into the open end of the case guide 52. As the case is advanced toward the cutter 50, the case body engages the collet 72. As the mouth of the case gets closer to the cutter 50, the mouth and/or neck of the case may engage the bushing 70, which begins to guide the mouth of the case into a centered position with respect to the cutter. By the time the case mouth engages the cutter 50, engagement of the case shoulder with the bushing 70 and engagement of the case body with the collet 72 has caused the case mouth to be centered with respect to the cutter and caused the longitudinal axis of the case to be aligned with the longitudinal axis of the cutter. The bushing 70 positively locates the case axially with respect to the cutter 50, defining the trim length. When the case mouth engages the rotating cutter head 50B, the result is the case is trimmed to the desired length and has a squarely trimmed mouth. Case after case may be inserted in the case guide 52 for trimming a plurality of cases.

As shown in FIGS. 7, 9, and 10, the tubular shroud 60 includes circular holes 90 which permit a user to view the cutter head 50B and case mouth as it is trimmed. The holes 90 also permit chips cut from the casing to exit the tubular shroud 60. In the illustrated embodiment, there are four holes 90 spaced around the circumference of the tubular shroud 60. Accordingly, no matter the rotational position of the tubular shroud 60, at least one of the holes 90 will be positioned for a user to view the cutter 50 and casing. Referring to FIG. 10, one of the holes 90 may be generally radially aligned on the tubular shroud 60 with the measurement marks 84 to permit a user to view the position of the case mouth with respect to the cutter head 50B at the same time as viewing the measurement marks.

The case guide 52 may also include a chip deflector 96 (FIGS. 7 and 10) for selectively covering the holes 90 to prevent chips from exiting some of the holes. In the illustrated embodiment, the chip deflector 96 is C-shaped for extending around about two-thirds of the tubular shroud 60. The chip deflector 96 has a length sufficient for covering three of the holes at one time. For example, the chip deflector 96 may be rotated on the tubular shroud 60 to cover all of the holes 90 except for the hole pointed generally downward for expelling chips downward. The chip deflector 96 is desirably transparent or translucent for permitting the user to see through the covered holes 90. The chip deflector 96 may be formed of somewhat resilient or bendable material so that it can be mounted on and removed from the tubular shroud in a radial direction by temporarily bending the deflector tending to straighten it.

Figure 11:
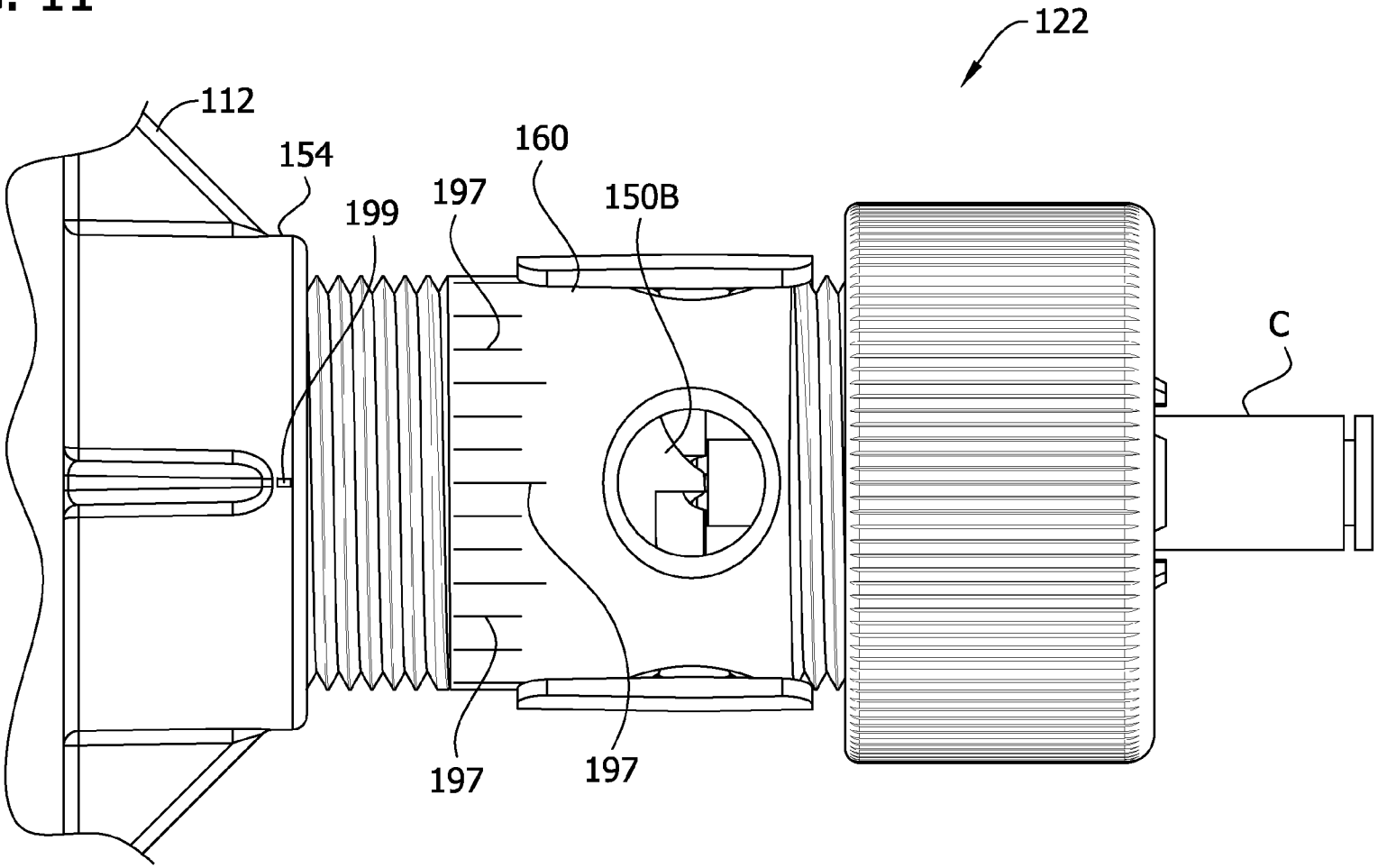
FIG. 11 is a view similar to FIG. 10 but of a second embodiment of a trimming assembly including different measurement marks.

Referring to FIG. 11, a second embodiment of a case trimming assembly is designated generally by the reference number 122. The case trimming assembly is identical to the assembly 22 described above except as noted hereafter. Features of this embodiment are designated by corresponding reference numbers, plus 100. This embodiment includes a different system for accurately adjusting a length to which a case is trimmed. The non-threaded intermediate portion of the tubular shroud 160 has a plurality of marks 197 (e.g., etched lines) spaced from each other about the circumference of the tubular shroud. The measurement marks 197 may be referred to as "clocking" or "dial" marks. A reference mark 199 is provided on the shroud 112 (e.g., on the neck 154). A user can "dial" the tubular shroud 160 into a proper position by rotating it and comparing positions of the measurement marks 197 to the reference mark 199. The reference marks 197 provide an indirect reference of how far the tubular shroud 160 is advanced into the neck 154. The measurement marks 197 may be used in the following manner to properly adjust the trimming length. First, the user inserts a case C of a known length in the trimming assembly 122, engaging the case shoulder against the bushing. The user then adjusts the tubular shroud 160 inward until the mouth of the case contacts the cutter head 150B (which is not rotating at this point). Now the user can note the position of the "clocking marks" around the circumference of the tubular shroud 160. They can also note the length of the case they have inserted by measuring it prior to insertion. Knowing the desired length they wish to achieve in comparison to the test case, they may then rotate the tubular shroud 160 to move the bushing toward or away from the cutter head 150B as needed. A reference guide may be provided with the trimming assembly 122 that estimates a correlation between trim length and the relative dialed position of the measurement marks 197. Alternatively, the reference guide may indicate an estimated change in trim length per unit change indicated by the marks. This may be a more precise method of tuning the length than the previously described measurement marks 84. For example, if the user desires to remove 0.025 inches in case length, the reference guide may instruct them to rotate the tubular shroud 160 clockwise by "X" units as indicated by the circumferentially spaced marks 197.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A case trimming apparatus for trimming an ammunition case, the case including a neck having a mouth to be trimmed, a shoulder behind the mouth, and a body behind the shoulder, the case trimming apparatus comprising:

a housing;

a cutter head supported by the housing for trimming the mouth of the case; and a case guide supported by the housing for guiding the case into position with respect to the cutter head for trimming the mouth of the case, the case guide including a case bearing bounding a case receiving opening sized and shaped for reception of the case in the case guide, the case receiving opening having a depth extending in a direction in which the case is receivable in the case receiving opening and a width extending transversely with respect to the depth, the case bearing including a case shoulder engagement member constructed to engage the case shoulder for determining a trim length of the case, the case bearing including a case body engagement member constructed to engage the case body for orienting the case with respect to the cutter head, the case bearing being adjustable to adjust the width of the case receiving opening to correspond to a width of the case;

wherein the case bearing comprises at least two case engagement surfaces configured for engaging the case at respective positions on the case, at least one of the case engagement surfaces being movable with respect to the other of said at least two case engagement surfaces to adjust a width of the case receiving opening to correspond to a width of the case.

2. A case trimming apparatus as set forth in claim 1 wherein the case body engagement member is adjustable to adjust the width of the case receiving opening to correspond to a width of the case body.

3. A case trimming apparatus as set forth in claim 2 wherein the case body engagement member comprises multiple case body engagement surfaces movable with respect to each other and configured to engage the case body at different positions on the case body.

4. A case trimming apparatus as set forth in claim 3 wherein the case bearing comprises a collet defining the case body engagement surfaces.

5. A case trimming apparatus as set forth in claim 4 wherein the collet includes an annular portion and fingers extending from the annular portion, the fingers defining the case body engagement surfaces.

6. A case trimming apparatus as set forth in claim 5 wherein the fingers are deflectable to change the width of the case receiving opening.

7. A case trimming apparatus as set forth in claim 1 wherein the case shoulder engagement member comprises an annular shoulder bearing surface having a diameter sized for engaging the case shoulder around a full circumference of the case shoulder.

8. A case trimming apparatus as set forth in claim 1 wherein the case bearing comprises a bushing defining the case shoulder engagement member.

9. A case trimming apparatus as set forth in claim 8 wherein the case guide includes a receiver sized for receiving the bushing, the bushing has a tapered bearing surface and the receiver has a corresponding tapered bearing surface for engaging the tapered bearing surface of the bushing to position the bushing with respect to the cutter head.

10. A case trimming apparatus as set forth in claim 1 wherein the case shoulder engagement member and the case body engagement member are separate pieces independently positionable with respect to each other.

11. A case trimming apparatus for trimming an ammunition case, the case including a neck having a mouth to be trimmed, a shoulder behind the mouth, and a body behind the shoulder, the case trimming apparatus comprising:

a housing;

a cutter head supported by the housing for trimming the mouth of the case;

a case guide supported by the housing for guiding the case into position with respect to the cutter head for trimming the mouth of the case, the case guide being constructed for supporting a case shoulder engagement member and a case body engagement member forming a case bearing bounding a case receiving opening and being configured for positioning the case with respect to the cutter head; and a kit including at least one case shoulder engagement member and at least one case body engagement member for forming the case bearing, the at least one case shoulder engagement member including a case shoulder engagement surface constructed to engage the case shoulder for determining a length of the case to be trimmed, the at least one case body engagement member including a case body engagement surface constructed to engage the case body for orienting the case with respect to the cutter head, the at least one case shoulder engagement member and the at least one case body engagement member being separate pieces independently positionable with respect to each other for forming the case bearing having the case shoulder engagement surface of the at least one case shoulder engagement member and the case body engagement surface of the at least one case body engagement member for positioning the case with respect to the cutter head;

wherein at least one of:

the at least one case shoulder engagement member comprises multiple case shoulder engagement members having different sizes for engaging case shoulders of different sizes, each case shoulder engagement member being independently positionable with respect to the at least one case body engagement member for forming the case bearing having the case shoulder engagement surface of the respective case shoulder engagement member and the case body engagement surface of the at least one case body engagement member; or the at least one case body engagement member comprises multiple case body engagement members having different sizes for engaging case bodies of different sizes, each case body engagement member being independently positionable with respect to the at least one case shoulder engagement member for forming the case bearing having the case shoulder engagement surface of the at least one case shoulder engagement member and the case body engagement surface of the respective case body engagement member.

12. A case trimming apparatus as set forth in claim 11 wherein the at least one case shoulder engagement member comprises multiple case shoulder engagement members having different sizes for engaging case shoulders of different sizes, each case shoulder engagement member being independently positionable with respect to the at least one case body engagement member for forming the case bearing having the case shoulder engagement surface of the respective case shoulder engagement member and the case body engagement surface of the at least one case body engagement member.

13. A case trimming apparatus as set forth in claim 12 wherein the kit includes bushings defining the case shoulder engagement members.

14. A case trimming apparatus as set forth in claim 13 wherein the bushings have tapered bearing surfaces and the case guide has a corresponding tapered bearing surface for engaging the tapered bearing surfaces of the bushings to position the bushings with respect to the cutter head.

15. A case trimming apparatus as set forth in claim 11 wherein the at least one case body engagement member comprises multiple case body engagement members having different sizes for engaging case bodies of different sizes, each case body engagement member being independently positionable with respect to the at least one case shoulder engagement member for forming the case bearing having the case shoulder engagement surface of the at least one case shoulder engagement member and the case body engagement surface of the respective case body engagement member.

16. A case trimming apparatus as set forth in claim 15 wherein the kit includes collets defining the case body engagement members.

17. A case trimming apparatus as set forth in claim 15 wherein the case body engagement members are adjustable to adjust the width of the case receiving opening to correspond to a width of the case body.

18. A case trimming apparatus for trimming an ammunition case, the case including a neck having a mouth to be trimmed, a shoulder behind the mouth, and a body behind the shoulder, the case trimming apparatus comprising:

a housing;

a cutter head supported by the housing for trimming the mouth of the case;

a case guide supported by the housing for guiding the case into position with respect to the cutter head for trimming the mouth of the case, the case guide including a tubular shroud and a case bearing in the tubular shroud configured for engaging the case and positioning the case with respect to the cutter head, the tubular shroud of the case guide at least partially housing the cutter head;

wherein the tubular shroud is supported by a threaded connection, the tubular shroud being selectively rotatable independent from the housing via the threaded connection for positioning the case bearing with respect to the cutter head for adjusting the trim length of the case.

19. A case trimming apparatus as set forth in claim 18 wherein the tubular shroud includes at least one opening in a side wall of the tubular shroud for permitting chips cut from the case by the cutter head to exit the tubular shroud.

20. A case trimming apparatus as set forth in claim 18 further comprising a plurality of reference marks on the tubular shroud for setting the trim length of the case based on a rotated position of the tubular shroud.

21. A case trimming apparatus for trimming an ammunition case, the case including a neck having a mouth to be trimmed, a shoulder behind the mouth, and a body behind the shoulder, the case trimming apparatus comprising:

a housing;

a cutter head supported by the housing for trimming the mouth of the case;

a case guide supported by the housing for guiding the case into position with respect to the cutter head for trimming the mouth of the case, the case guide including a tubular shroud and a case bearing in the tubular shroud configured for engaging the case and positioning the case with respect to the cutter head, the tubular shroud of the case guide at least partially housing the cutter head;

wherein the housing includes a front end adjacent the case guide and a rear end opposite the front end, the case trimming apparatus further comprising a support member connected to the housing adjacent the front end of the housing and extending below the front end of the housing for supporting the front end of the housing in a raised position relative to the rear end.

* * * * *